United States Patent [19]

Cavagna

[11] Patent Number: 5,069,098

[45] Date of Patent: Dec. 3, 1991

[54] LIMIT SWITCH FOR THE SELECTIVE POSITIONING OF CUTTING UNITS IN AN APPARATUS FOR THE CUTTING OF PLASTIC AND/OR PAPER MATERIALS

[75] Inventor: Elio Cavagna, Melegnano, Italy

[73] Assignee: Elio Cavagna S.r.l., Milan, Italy

[21] Appl. No.: 557,554

[22] Filed: Jul. 24, 1990

[30] Foreign Application Priority Data

Aug. 1, 1989 [IT] Italy ..... 21400 A/89

[51] Int. Cl.[5] ..... B26D 1/24; B26D 5/02

[52] U.S. Cl. ..... 83/62.1; 83/72; 83/76.7; 83/499; 83/522.22

[58] Field of Search ..... 83/62, 62.1, 72, 76.7, 83/76.1, 425.4, 499, 508.3, 522.22

[56] References Cited

U.S. PATENT DOCUMENTS 3,882,764 5/1975 Johnson ..... 83/499
3,886,833 6/1975 Gunn et al. ..... 83/499
4,283,981 8/1981 Trautmann ..... 83/884
4,607,552 8/1986 Siler ..... 83/499

*Primary Examiner*—Hien H. Phan
*Attorney, Agent, or Firm*—Bucknam and Archer

[57] ABSTRACT

Limit switch for the positioning of cutting machines in a machine for the cutting of plastic and/or paper materials in strips of predetermined width, this cutting unit being slidable on supporting beams, which device includes a source (31) of a ray of light (50) parallel to the supporting beam (24) of the cutting units (12); a tappet (33) of this ray of light; a rotating L-shaped plate (36) hinged in (40) to one side of the base of each cutting unit (12) and maintained in parallel position to said ray of light (50) by a spring (42); an actuating plate (38) fixed in adjustable position to the other side of each cutting unit, in opposite position and aligned with said rotating L-shaped plate (36); and an electronic station driven by the interception of said ray of light (50).

7 Claims, 2 Drawing Sheets

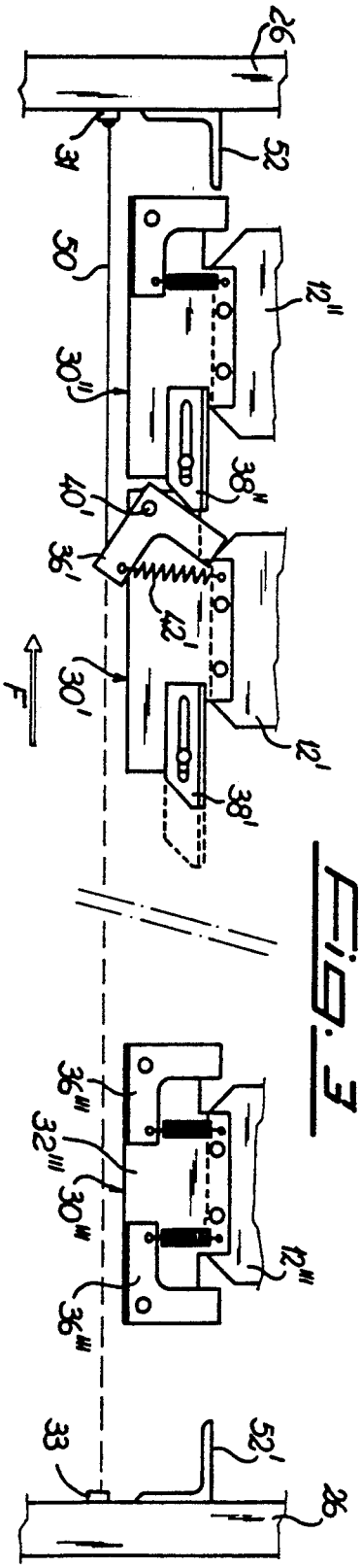
Fig. 3
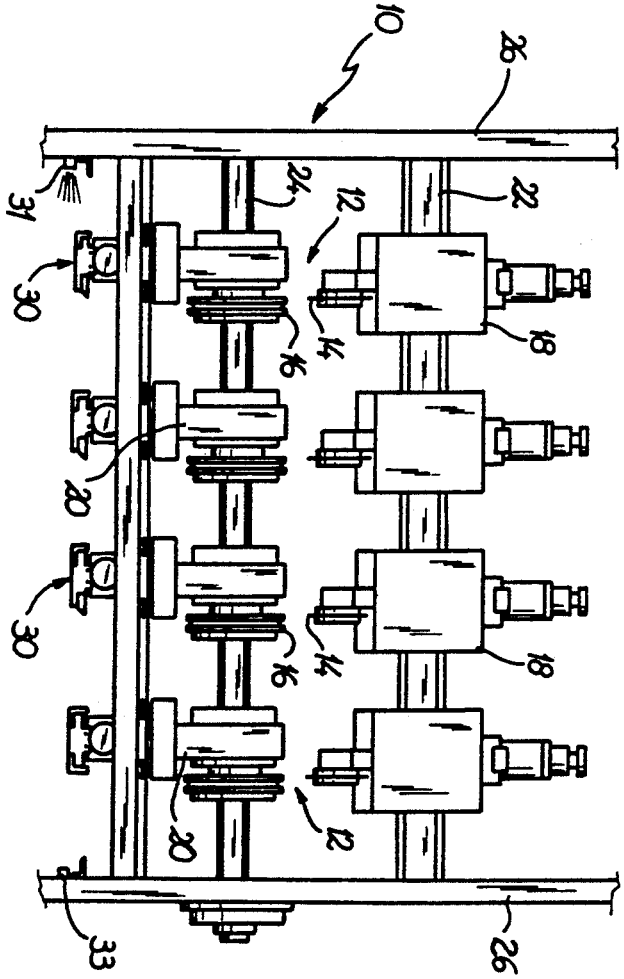

LIMIT SWITCH FOR THE SELECTIVE POSITIONING OF CUTTING UNITS IN AN APPARATUS FOR THE CUTTING OF PLASTIC AND/OR PAPER MATERIALS

The present invention concerns a limit switch for the selective positioning of cutting units in a machine the cutting of plastic and/or paper materials into strips of predetermined width.

As known in the cutting art, the machines used to cut, generally in strips, plastic and/or paper material include a plurality of cutting units, sliding on supporting beams, each substantially composed of a blade and counterblade, and means of control and movement.

These cutting units are selectively positioned through traverse on the beams or on equivalent means of support, with one spaced from the other in relating to cutting requirements of the material, in particular to the width of the strips.

This selective positioning is generally obtained by magnetic limit stop sensors, which, arranged in each cutting unit, signal, by means of an electric circuit, the positions of these cutting units to an electronic station. This exchange, suitably programmed, activates the means of movement for the traverse of the abovementioned cutting units which are arranged in sequence on the beam, or equivalent means of support, in the prefixed position.

The abovementioned magnetic limit stop sensors, while fulfilling their function fairly satisfactorily, present notable problems.

The main problem derives from the dimensions of the electric cables which connect the magnetic sensors to the electronic exchange. These cables, in fact, notably block the positioning and the movement of the cutting units of the machine along the supporting beam.

Another important problem is that the electric cables may deteriorate or break during use, since, for operative requirements, the positioning of the cutting units can be carried out frequently and in diversified manner.

This undesired deterioration or breakage of the electric cables involves the stopping of the operative cycle of the machine, thus limiting its productive efficiency and therefore raising its running costs.

Furthermore, as mentioned above, the cutting units are driven and moved by controls given by means of motors from an electronic exchange in order to automize the operative cycle of the apparatus.

Therefore, the substitution of one or more of the abovementioned deteriorated electric cables generally implies a new programming of the positioning of the cutting units. This operation involves a further limitation of the efficiency and output of the apparatus.

The present invention provides a limit switch for the selective positioning of the cutting units in a machine for the cutting of strips of plastic and/or paper material, which eliminates all the above problems.

According to the present invention, a limit switch for the selective positioning of cutting units, sliding along a supporting beam, which does not present the abovementioned problems of limitation of efficiency and output of the machine, comprises:

source of a ray of light fixed to the frame of the apparatus near the supporting beam, whose emitted ray of light is parallel to said supporting beam;

a light receiver of said ray of light fixed to the frame of the apparatus in position opposite that of the source of the ray of light;

a rotating means, hinged to one side of the base of each cutting unit and kept in parallel position to said ray of light by elastic means;

an actuating plate fixed to the other side of the base of each cutting unit, in position opposite that to which the rotating means is hinged and in alignment with the latter; this actuating plate being able to act on said rotating means to move it from its parallel position to that of interception of the ray of light, and an electronic station driven by the interception of the ray of light for the positioning of the cutting unit. Preferably, this rotating means and this actuating plate are essentially composed of plate-shaped elements, connected to the structure of each cutting unit by means of a plate or similar supporting element.

The rotating means, in particular, is a plate-shaped element with "L" form.

According to another feature of the device according to the invention, the actuating plate can be adjustably positioned to the structure of the respective cutting units to permit a spacing between same in relation to dimensional cutting requirements of the material, in particular to the width of the strips which must be obtained.

These and other features of the device of the present invention will be evident from the following detailed description in which reference is made to the figures of the attached drawings which illustrate a preferred form of embodiment of this device, given as unbinding example, in which:

FIG. 1 is a front schematic view of an apparatus for the cutting of plastic and/or paper materials comprising a plurality of cutting units, each equipped with limit switch according to the invention;

FIG. 3 shows in front schematic view the operation of the device of FIG. 2 while selectively positioning the cutting units in an apparatus.

Figure 2:
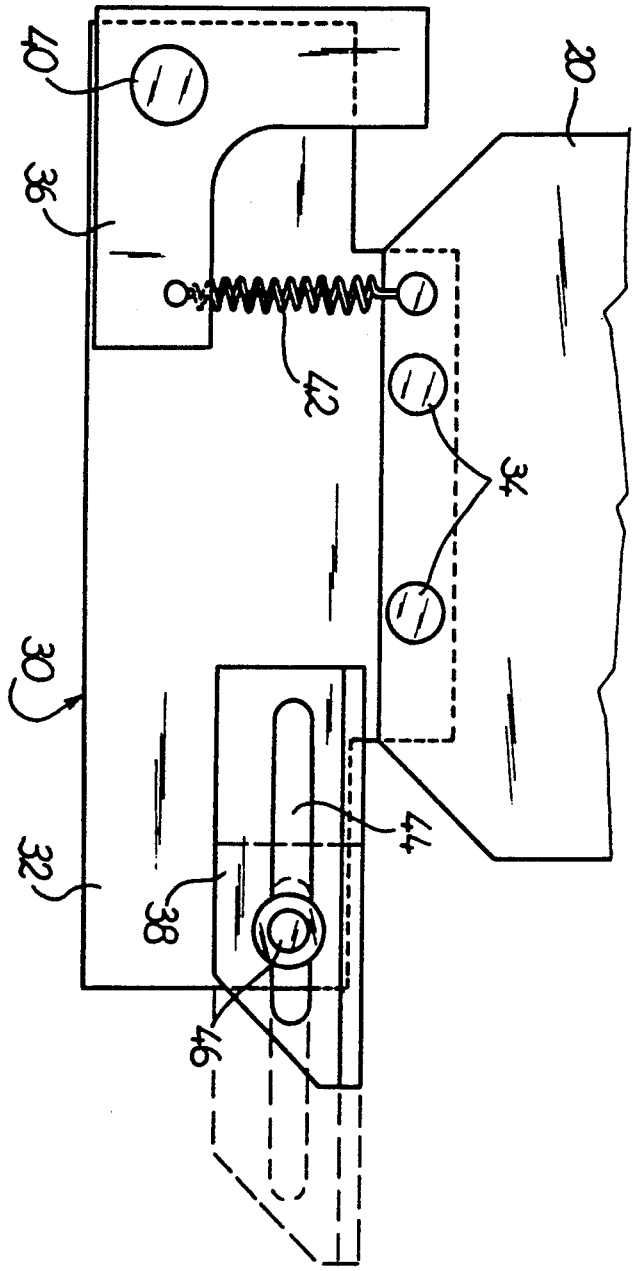
FIG. 2 is the enlarged, front schematic view of the limit switch of the invention, connected to the structure of a cutting unit, the latter partially illustrated.

With reference to FIG. 1, the apparatus (10) for the cutting of plastic and/or paper materials into strips of predetermined width comprises a plurality of cutting units (12).

Each cutting unit (12) is known in itself, and, in particular, includes a blade (14) and a counterblade (16) respectively supported by structures (18) and (20).

These cutting units (12) slide on supporting beams (22) and (24) respectively: these latter supported by the frame (26) of the apparatus (10). According to the dimensional requirements of the strips of material to be cut, in particular to their width, the cutting units (12) are positioned at various distances one from the other on the beams (22) and (24). This position is reached with the limit switch of the present invention, indicated as a whole with numeral (30), subsequently described, applied on each of the cutting units (12) on the part opposite that supporting the blade (14) or the counterblade (16). This device (30) cooperates with a photo-electric cell (31), equipped with relevant light receiver (33), both fixed to the frame (26) in opposite position, near each slip beam (22, 24). The ray of light emitted by this photo-electric cell (31) is parallel to the slip beam (22, 24) and is intercepted by the light receiver (33).

According to a preferred embodiment shown in FIG. 1, the limit switch (30) is connected in the lower part of the structure (20), supporting the counterblade (16), by a plate (32) fixed with screws (34) to the same structure.

It is evident, however, that the device (30) can be positioned differently on the structures of the respective cutting units (12) in relation to both the conformation of this cutting unit (12) and to the structural requirements of the apparatus (10).

Furthermore, in the case illustrated in FIG. 1, this device (30) is applied to cutting units of the type specified above, but it is evident that it can be applied to cutting units of other type, for example including only one blade.

Referring now to FIG. 2, the limit switch (30) of the present invention includes a first rotating means which, contrasted by an actuating plate, intercepts the ray of light of the photo-electric cell (31), as described below.

The first rotating means is essentially composed of at least one plate-shaped element (36) of "L" form, hinged in (40), near its top, to one side of the plate (32).

This "L" element (36) is therefore rotatable around this pin (40), if contrasted by the actuating plate, described below.

The "L" element (36) is maintained in inoperative position, i.e. in parallel position to the ray of light of the photo-electric cell, by means of at least one elastic element, for example a spring (42).

The actuating plate consists of a small plate (38), substantially rod-shaped, positionable on the plate (32) in such a way as to be able to be adjusted.

This small plate (38) is equipped with a slot (44) in which is arranged a locking means, like a nut (46), equipped with washers. This locking means makes it possible to fix the small plate (38) in the required position, on the side of the plate (32) opposite that on which the "L" element (36) is hinged. As subsequently specified, the small plate (38) is suitable both to contrast the "L" element (36), making it rotate, and to define the distance between one cutting unit (12) and the next.

Referring now to FIG. 3, a brief description is given of the operation of the limit switch (30) of the present invention to selectively position the cutting units (12) in an apparatus (10) for the cutting of plastic and/or paper materials. In FIG. 3 the same numerical references will be indicated with one or more indexes for greater descriptive clarity of the operation of the limit switch.

First reference is made to the limit switch (30') applied to a cutting unit (12') partially illustrated.

This cutting unit (12') is made traverse, by means of known motor means not shown in figure, in the direction indicated by the arrow F, along the supporting beam (24), until the plate-shaped element (36') comes into contact with the small rod-shaped actuating plate (38") present on a device (30") applied to a cutting unit (12") adjacent to (12').

Contrasted by this small plate (38"), the element (36') rotates around the pin (40') by an angle sufficient to take up such a position (illustrated in figure) that the lower side of same intercepts the ray of light (50) of the photo-electric cell (31). The light receiver (33) of this photo-electric cell is connected to an electronic station, not shown as known in itself.

When the ray of light (50) is intercepted by the rotating element (36'), the electronic station provides a traverse of the cutting unit (12') in opposite direction to the arrow F, for a programmed section, so that the element (36'), no longer contrasted by the small plate (38") is returned by the spring 42' to its inoperative position, with the lower side parallel to the ray of light (50).

After re-establishing the contact of the photo-electric cell (31) with the light receiver (33), the electronic station will proceed with the traverse and relevant positioning of a cutting unit adjacent to unit (12'), according to the methods described above and so on for the plurality of cutting units present in the apparatus (10).

The distance between adjacent cutting units can be easily established by means of the small plate (38). In fact, as shown in FIG. 3, this small plate can be moved, along its slot (44), until it takes up, for example, the position indicated with dotted line, thus increasing the space between adjacent cutting units.

If cutting requires larger dimensions, this small plate (38) can be easily substituted by a similar one of greater length. In the description just made, reference is made to the sequential positioning of a plurality of cutting units (12) made traverse in the direction indicated by the arrow F, but it is evident that this positioning can be carried out also in the opposite direction, operating in a similar way to that described above.

Again with reference to FIG. 3, to the frame (26) of the apparatus (10) are fixed angles or projections (52, 52') which act as means of contrast with the oscillating plate-shaped element (36) of one of the end cutting units (12). The other end cutting unit (12''') is equipped with two oscillating plate-shaped elements (36'''), hinged to the opposite sides of the plate (32'''), which are engaged in contrast, respectively, with the angle (52') and with the means of contrast (38) of the adjacent cutting unit.

Therefore, the angles (52, 52') define the position of the first cutting unit (12), in the way described above, be it placed at the left end or the right end of the machine (10), as they are in relation to the direction of traverse of the same cutting units 12).

Finally, as mentioned above, the means for the movement of the cutting units (12), and the operation of the electronic station have not been described or shown as they are of known type and can be embodied in any way.

From what has been described above the advantages and useful effects of the device of the present invention are evident, as it permits an easy, quick, reliable positioning of a plurality of cutting units in an apparatus for the cutting of plastic and/or paper materials in strips of predetermined width. Furthermore, the device of the present invention makes it possible to simplify the structure of the apparatus considerably, since, principally, the connecting electric cables with magnetic limit stop sensors present in the conventional apparatuses which, as already mentioned, notably block the movement of the cutting units, are eliminated.

I claim:

1. In a machine for cutting plastic and paper materials into strips of predetermined width, which includes a frame (26), a plurality of cutting units (12), said frame having opposite ends, each of said cutting units including an upper blade (14) and a lower counterblade (16), said machine comprising an upper element (18) and a lower base (20) for supporting said blade and said counterblade respectively, said cutting units sliding by motor means on an upper beam (22) and a lower beam (24), said upper and said lower beam being supported by said frame, said motor means being driven by an electronic station, a limit switch for selective positioning each of said cutting units, which comprises: a source of a ray of light (31) fixed to said frame (26) in the proximity of said lower beam (24), said source of a ray of light (31) emitting a ray of light (50) which is parallel to said lower beam (24); a light receiver (33) of said ray of light fixed to said frame, said source of a ray of light (31) and said light receiver being fixed at said opposite ends of said frame, a rotating means (36) hinged (40) to one side of said lower base (20) of each cutting unit (12) and maintained in parallel position to said ray of light (50) by elastic means (42) when in an inoperative position; actuating means (38) fixed to the other side of the lower base of each cutting unit (12), in position opposite that at which the rotating means (36) is hinged and in alignment with said rotating means; each of said actuating means of each cutting unit acting on the rotating means of the immediately adjacent cutting unit to pivot said rotating means from said inoperative position to a pivoting position wherein said rotating means intercepts the ray of light (50), whereby said electronic station changes the direction of motion of each of said cutting units.

2. The switch according to claim 1, wherein said rotating means (36) and said actuating means are supported by a second plate (32) fixed to said lower base (20) of the respective cutting unit.

3. The switch according to claim 2 wherein each of said rotating means (36) consists of an L-shaped plate having two arms at right angle joining at point (40), said plate being hinged at said point (40) on said second plate (32), said L-shaped plate (36) being partially rotatable when contacted by said actuating means (38), by an angle sufficient to permit one arm of said L-shaped plate to intercept said ray of light (50).

4. The switch according to claim 3 wherein said frame (26) has projections (52,52') at both ends and said L-shaped plate of each of two end cutting units (12'',12''') engages with said projections.

5. The switch according to claim 4 wherein one of the end cutting units (12''') is provided with two rotating L-shaped elements (36''') hinged on the opposite sides of said second plate (32''').

6. The switch according to claim 2 wherein said actuating means (38) is composed of a small substantially rod-shaped plate, said second plate (32) having two sides, said rod-shaped plate having a slot (44), locking means (46) located in said slot, said locking means fixing said rod-shaped plate to said second plate (32), said rod-shaped plate being arranged on said second plate (32) at the side opposite the side where the L-shaped element (36) is hinged, the position of said small rod-shaped plate (38) being adjusted according to the pre-established distance between two adjacent cutting units (12).

7. The switch according to claim 1 wherein the source of a ray of light (31) is a photoelectric cell.

* * * * *